US005458423A

United States Patent [19]

Sims et al.

[11] Patent Number: 5,458,423

[45] Date of Patent: Oct. 17, 1995

[54] TAPE CUTTING APPARATUS

[75] Inventors: Charles R. Sims, Herts; Andrew R. B. Halket, Cambridge; Michael A. Beadman, Herts, all of United Kingdom

[73] Assignee: Esselte Dymo N.V., St. Niklaas, Belgium

[21] Appl. No.: 69,256

[22] Filed: May 28, 1993

[30] Foreign Application Priority Data

Jun. 11, 1992 [GB] United Kingdom ..... 9212423

[51] Int. Cl.[6] ..... B41J 11/68

[52] U.S. Cl. ..... 400/621; 83/865

[58] Field of Search ..... 400/621, 582; 83/52, 861, 862, 865, 375, 378, 379, 384, 381, 382

[56] References Cited

U.S. PATENT DOCUMENTS

| | | | |
|---|---|---|---|
| 1,742,295 | 1/1930 | Young | 83/881 |
| 3,237,494 | 3/1966 | Norvelle | 83/862 |
| 3,414,102 | 12/1968 | Norvelle | 400/621 |
| 3,530,028 | 9/1970 | Messmer | 156/584 |
| 4,407,179 | 10/1983 | Iwase et al. | 83/865 |
| 4,685,991 | 8/1987 | Herrmann et al. | 156/344 |
| 5,066,152 | 11/1991 | Kuzuya et al. | 400/621 |
| 5,222,818 | 6/1993 | Akiyama et al. | 400/621 |

FOREIGN PATENT DOCUMENTS

| | | | |
|---|---|---|---|
| 0077127A2 | 4/1983 | European Pat. Off. . | |
| 0215397A2 | 3/1987 | European Pat. Off. . | |
| 0319209 | 6/1989 | European Pat. Off. . | |
| 0506257A1 | 9/1992 | European Pat. Off. . | |
| 0526213A2 | 2/1993 | European Pat. Off. . | |
| 1173784 | 7/1964 | Germany . | |
| 3730810A1 | 3/1989 | Germany . | |
| 284962 | 12/1991 | Japan | 400/621 |
| 2008028 | 5/1979 | United Kingdom . | |
| WO89/10888 | 11/1989 | WIPO . | |

*Primary Examiner*—David A. Wiecking
*Attorney, Agent, or Firm*—Pennie & Edmonds

[57] ABSTRACT

A tape printing device is described which has cutting means capable of providing a tab cut and a multiple strip of labels. The printing device also enables label lengths to be controlled and to control the cutting process in response to these label lengths.

33 Claims, 5 Drawing Sheets

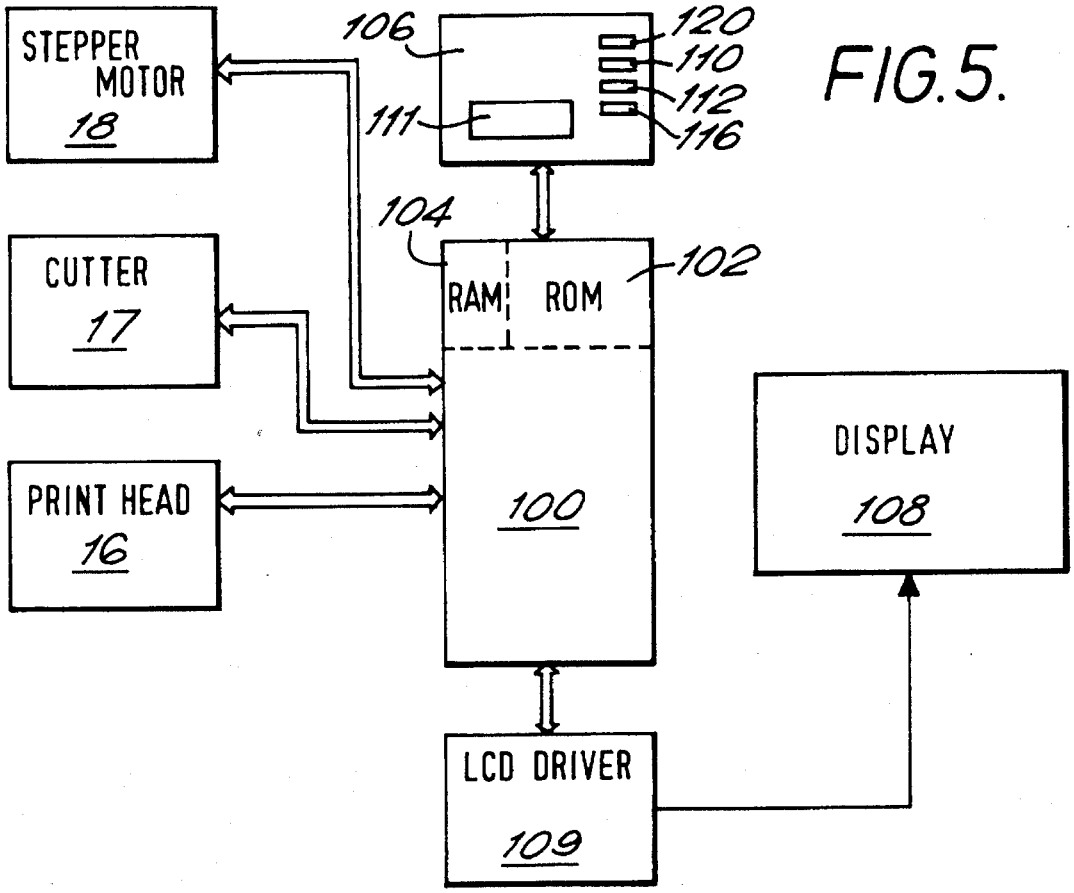
FIG.5.
FIG.6a.
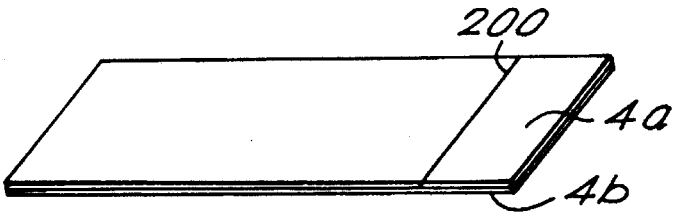
FIG.6b.
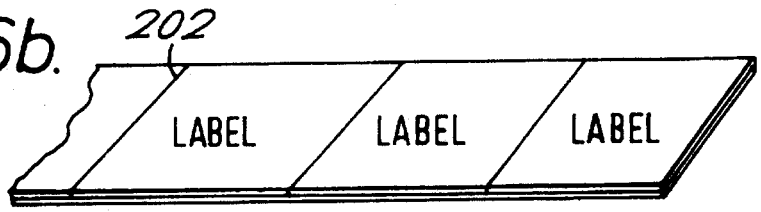

TAPE CUTTING APPARATUS

FIELD OF THE INVENTION

This invention relates to a tape cutting apparatus and is particularly concerned with cutting tape in printing devices.

BACKGROUND OF THE INVENTION

Thermal printing devices of the general type with which the present invention is particularly but not exclusively concerned are known. They operate with a supply of tape arranged to receive an image and a means for transferring an image onto the tape. In one known device, the tape holding case holds a supply of image receiving tape and a supply of an image transfer ribbon, the image receiving tape and the transfer ribbon being passed in overlap through a printing zone of the printing device. At the print zone, a thermal print head cooperates with a platen to transfer an image from the transfer ribbon to the tape. A printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releaseable backing layer by a layer of adhesive.

Once an image or message has been printed on the tape, it is desired to cut off that portion of the tape to enable it to be used as a label. For this purpose, it is necessary to remove the releaseable backing layer from the upper layer to enable the upper layer to be secured to a surface by means of the adhesive layer. With existing printing devices, it is difficult to remove the releaseable backing layer from the upper layer: it is necessary first to separate the closely adhered end portions of the releaseable backing layer and the upper layer, for example using a fingernail or tweezers so that the separated end portion of the releaseable backing layer can be finger gripped to peel it off the adhesive layer. This is a relatively difficult procedure and furthermore can result in the ends of the label being damaged in the process.

There have been several attempts to solve this problem. One approach is to provide a so-called tab cut. In these devices, a first cut is made completely through all the layers of the tape to cut off a portion of the tape and at the same time a cut is made through only one layer of the tape. This provides a "tab" which, in theory, can be peeled away reasonably easily. While a tab cut has been implemented successfully with relatively thick, stiff upper layers there are significant difficulties in implementing so-called tab cut devices for tapes of the type used in thermal printing devices, where the upper layer is generally a thin, resilient polyester material. Although there have been several proposals, no such tab cut has successfully been implemented in a thermal printing device. By way of example, reference is made to EP-A-0319209 which describes one attempt to form a tab cut system.

In that system, two blades are provided on a cutter support, the blades having different heights so that they penetrate the tape to different extents. In this way, one blade cuts through all the layers of the tape at one location while the other blade cuts only through the releaseable backing layer.

One problem which arises with the tab cutting apparatus described in EP-A-0319209 is the control of the height of the blades to ensure that there is reliability in that one blade always cuts through the whole tape and the other blade only cuts through the backing layer. This is difficult to achieve where tapes of differing thicknesses are provided for use with the cutting apparatus. A variation in thickness such that could arise due to normal manufacturing tolerances could even give rise to problems in this respect.

Another difficulty is that the tab cut depends on making two cuts simultaneously from the common cutter support, requiring increased force to be applied by the user. The force is applied manually and the force applied by some users may be insufficient to provide a proper tab cut, causing the label to be damaged when the backing is removed. Conversely too great a force may cause both tapes to be fully cut in both positions, leaving a portion of material within the cutting mechanism.

These problems have meant that to date the above described system has not been successfully implemented.

SUMMARY OF THE INVENTION

According to the present invention there is provided a tape cutting apparatus comprising: first cutting means arranged to cut off a portion of tape having an image receiving layer on which an image has been printed, and a releaseable backing layer, the first cutting means comprising two blades cooperable to form a scissor cut; second cutting means comprising a resiliently mounted blade arranged to cut completely only through one of said layers of said tape and not through the other of said layers; and drive means controllable to actuate the first and second cutting means so as to cut off a portion of said tape while cutting only through one layer of said tape at a position spaced apart from the cut off edge.

In one embodiment, one of the blades of the first cutting means is fixed while the other of the blades is arranged to move towards the fixed blade when actuated by the drive means. The moving one of the blades is secured to a control arm which actuates the resiliently mounted blade of the second cutting means. The resiliently mounted blade acts against an anvil which can form part of the tape cutting apparatus or can be provided as a part of a thermal printing device with which the tape cutting apparatus is to cooperate.

Preferably, the drive means comprises an electric motor and a gear train. In the described embodiment, the gear train comprises a worm gear which drives through at least one intermediate gear a cam having a cam track in which rides the control arm for the resiliently mounted blade of the second cutting means.

Means can be provided for disconnecting the first cutting means from the drive means while the second cutting means remains driven thereby. In this way, it is possible for a thermal printing device to produce a continuous strip of labels, separated one from another by a cut but being secured to a common backing layer. This is not possible with the prior art printing devices described above since each time a cutting operation is implemented a cut is made all the way through the image receiving tape to cut off the printed portion in its entirety.

According to the present invention in another aspect there is provided a printing device comprising means for printing a desired image onto an image receiving tape comprising an image receiving layer for receiving an image and a releaseable backing layer; first cutting means arranged at a first cutting zone to cut off a portion of the image receiving tape which has been printed; second cutting means arranged at a second cutting zone to cut through the image receiving layer of the image receiving tape while leaving the backing layer substantially intact, said second cutting zone being spaced from said first cutting zone; and means for disabling said first cutting means while permitting operation only of said second cutting means, such that when a strip label mode of operation of the printing device is selected the printing device is operable to print an image onto a portion of the image receiving tape, to feed the image receiving tape to the second cutting zone, to cut through the image receiving layer and to repeat said operations for subsequent portions of the image receiving tape whereby a strip of labels is produced.

In this context the word "label" is used to denote a portion of the image receiving layer which has been printed and which can be removed from the backing layer individually from its neighbours.

Preferably the first and second cutting means are driven from a common drive mechanism and the means for disabling the first cutting means comprises means for disconnecting the first cutting means from the drive mechanism.

In one embodiment, the second cutting means is driven through a control arm and a spring loaded pin secures the first cutting means to the control arm of the second cutting means. There is a lever which operates a cam such that on rotation of the lever and the cam the pin is caused to move under the action of the spring to disconnect the first cutting means from the control arm. In this way, the second cutting mans is driven while the first cutting means is not.

In the described embodiment, the first cutting means comprises two blades which cooperate to perform a scissor cut, one of the blades being movable with the control arm. The second cutting means comprises a resiliently mounted blade actuated by the control arm.

In one embodiment, the strip label mode is executed by a user entering data into an input device of the printing device. In another embodiment, the printing device is provided with means for sensing movement of the means for disabling the first cutting means to automatically instigate the strip label mode.

Preferably, the printing means comprises a platen and a print head, the platen being rotatable to act as a feeding means to feed the image receiving tape to the cutting zone. This obviates the need for a separate feeding means between the printing means and the cutting zone and thus enables the distance between the printing means and the cutting zones to be reduced.

The feeding means can be controlled to feed the tape under the action of a controller which is operable to receive data input by a user representative of characters to be printed, and to calculate a length of label to be printed including the calculation of a lead length of blank tape before a print start position and a lag length of blank tape after a print end position. The length of label can either be calculated by the controller in dependence on the character and spaces input by a user or can be input directly by a user. Whether the label length is calculated by the controller or set by a user, lead and lag lengths are set by the controller in proportion to the label length and size of character to be printed.

The controller can thus control feeding of the tape so that a final label is produced with the appropriate lead and lag and length of print. This involves controlling the distance through which the tape is fed relative to the cutting zones. When the device is in strip label mode, the feed distance for determining the lag length is automatically set by the controller to be greater than in the normal mode by the distance between the first and second cutting zones since the second cutting zone defines the end of the label instead of the first cutting zone.

The controller is operable in the described embodiment to control the feeding means via a stepper motor by converting the stored lead, lag and print length into appropriate pulse strings for supplying to the stepper motor, each pulse string having an appropriate number of pulses equivalent to the stored feed length.

According to another aspect of the present invention there is provided a printing device comprising means for printing a desired image onto an image receiving tape, said printing means being operable to feed the image receiving tape under the control of a stepper motor; cutting means arranged at a cutting zone to cut a portion of the image receiving tape; and a controller operable to receive data input by a user representative of characters to be printed and to hold label information comprising a lead length, characters to be printed and a lag length, the controller comprising means for converting the lead length and lag length into pulse strings for controlling the stepper motor so that the tape is fed to the cutting zone by appropriate distances before respective cutting operations are implemented to determine the front and rear edges of the label.

According to another aspect of the invention there is provided a printing device comprising means for printing a desired image onto an image receiving tape; a stepper motor operable to feed the image receiving tape; cutting means arranged at a cutting zone to cut a portion of the image receiving tape; and a controller operable to receive data input by a user representative of characters to be printed and to hold label information comprising a lead length, characters to be printed and a lag length, the controller comprising means for converting the lead length and lag length into pulse strings for controlling the stepper motor so that the tape is fed to the cutting zone by appropriate distances before respective cutting operations are implemented to determine the front and rear edges of the label.

For a better understanding of the present invention, and to show how the same may be carried into effect, reference will now be made by way of example to the accompanying drawings.

BRIEF DESCRIPTION OF THE DRAWINGS

FIG. 5 is a diagrammatic sketch showing the control circuitry for the printing device;

FIG. 6*a* and 6*b* are diagrams showing labels which can be produced using the printing device;

DESCRIPTION OF THE PREFERRED EMBODIMENT

Figure 1:
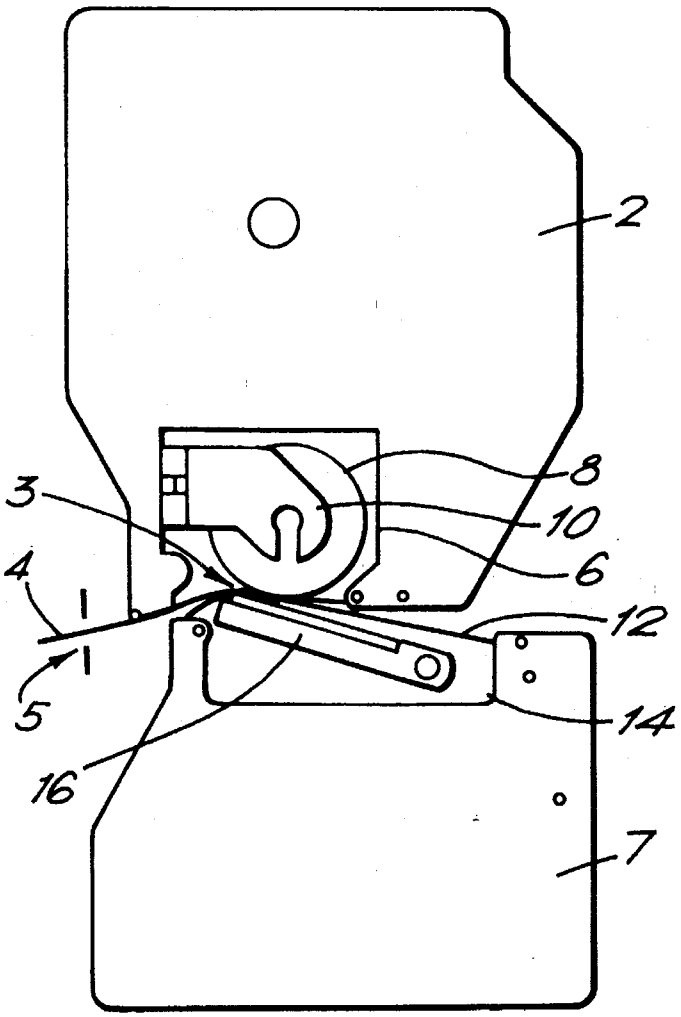
FIG. 1 is a plan view showing two cassettes inserted in a printing device.

FIG. 1 shows in plan view two cassettes arranged in a printing device. The upper cassette 2 contains a supply of image receiving tape which passes through a print zone 3 of the printer to an outlet 5 of the printer. The image receiving tape 4 comprises an upper layer 4*a* for receiving a printed image on one of its surfaces and having its other surface coated with an adhesive layer to which is secured a releaseable backing layer 4*b* (see FIG. 6). The cassette 2 has a recess 6 for accommodating a platen 8 of the printer. The platen 8 is mounted for rotation within a cage moulding 10.

The lower cassette 7 contains a thermal transfer ribbon which extends from a supply spool to a take-up spool within the cassette 7. The thermal transfer ribbon 12 extends through the print zone 3 in overlap with the image receiving tape 4. The cassette 7 has a recess 14 for receiving a print head 16 of the printer. The print head 16 is movable between an operative position, shown in FIG. 1, in which it is in contact with the platen and holds the thermal transfer ribbon 12 and the image receiving tape in overlap between the print head and the platen and an inoperative position in which it is moved away from the platen to release the thermal transfer ribbon and image receiving tape. In the operative position, the platen is rotated to cause image receiving tape to be driven past the print head and the print head is controlled to print an image onto the image receiving tape by thermal transfer of ink from the ribbon 12. The print head is a conventional thermal print head having an array of pixels each of which can be thermally activated in accordance with the desired image to be printed.

Figure 2:
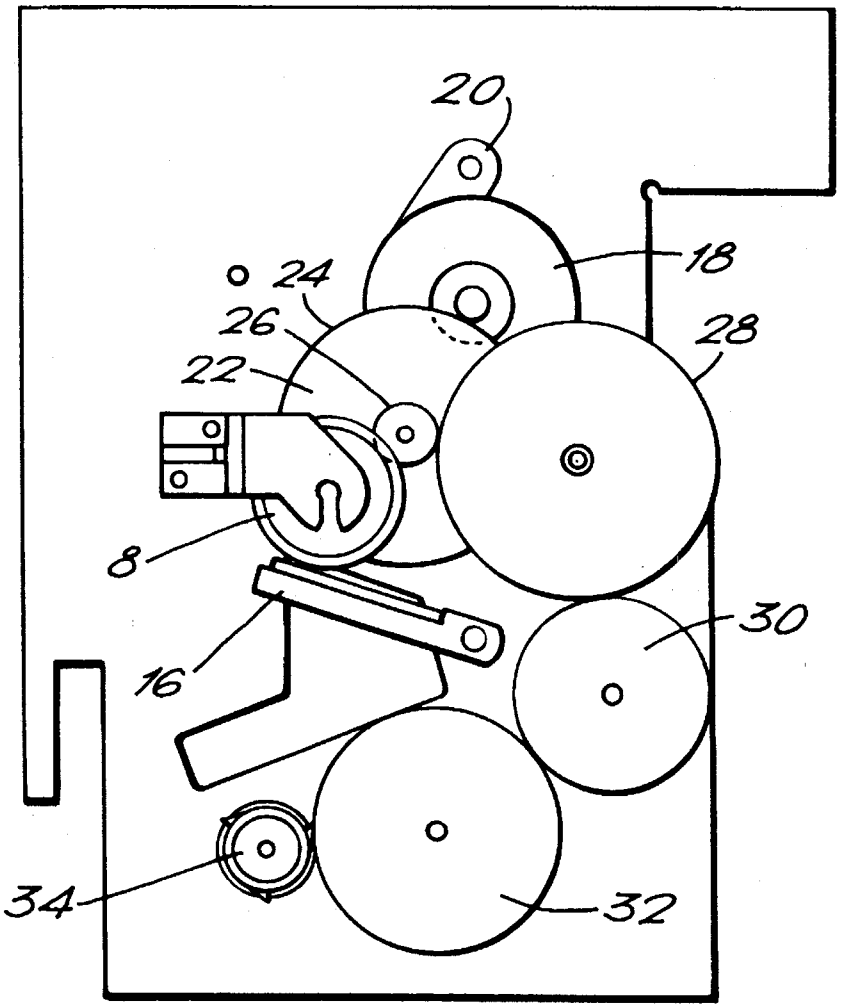
FIG. 2 is a diagrammatic plan view showing a drive train for a platen of the printing device.

FIG. 2 shows the drive train of the printing device. The printing device carries a stepper motor 18 secured to the base of the printing device by a bracket 20. The motor drives a double radius gear 22 on its larger diameter 24 while its smaller diameter 26 drives the platen 8 and a second gear wheel 28. The second gear wheel 28 drives through an intermediate gear 30 a third gear 32 which drives the take-up spool for the ink ribbon in the cassette 4. The take-up,spool is designated by reference numeral 34 in FIG. 2.

The stepper motor 18 drives the platen 8 in steps so that for each position of the platen a line of print is printed on the image receiving tape 4. The platen 8 drives the image receiving tape through the print zone under the action of its own rotation. The rotation of the platen and the energisation of the print head 16 are controlled by a microprocessor as described in more detail hereinafter.

Figure 4:
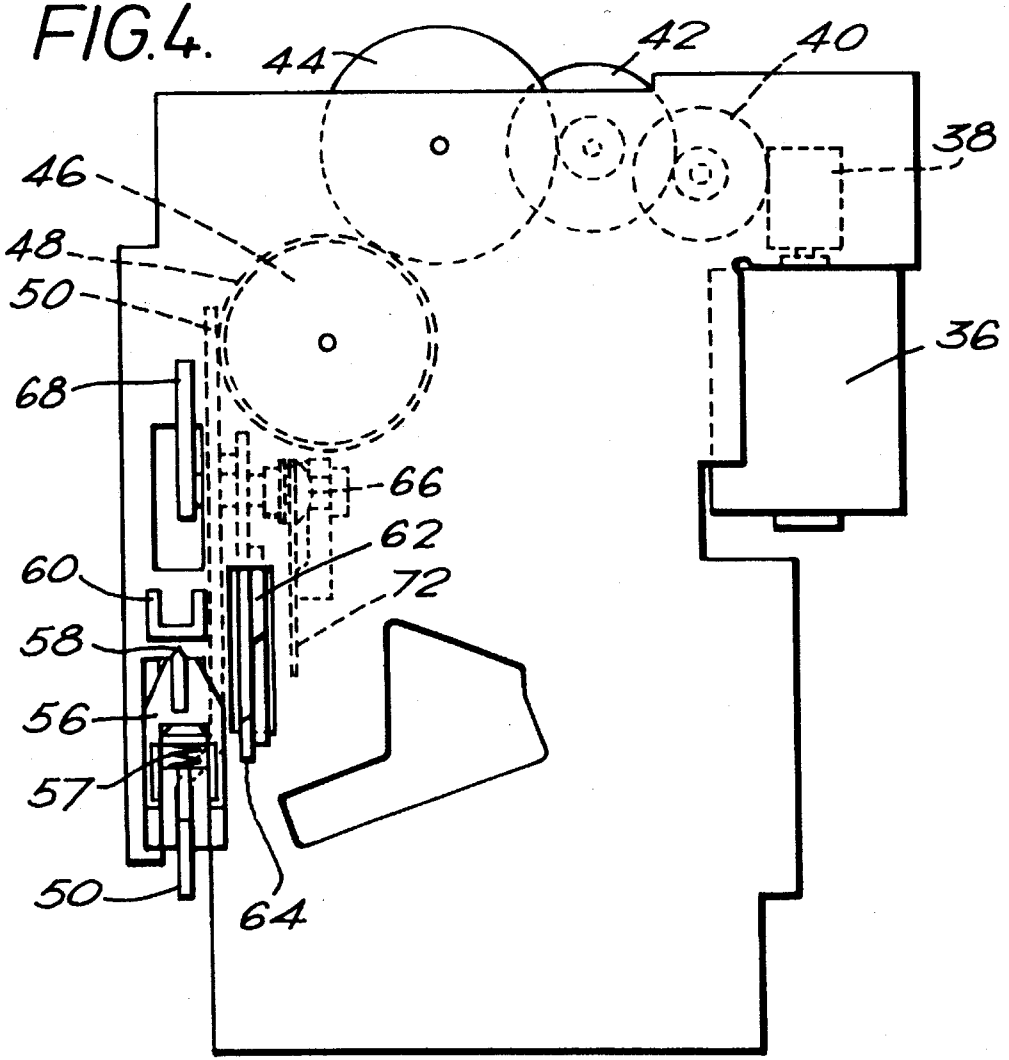
FIGS. 3 and 4 are side and plans view respectively of a cutting mechanism of the printing device.
Figure 3:
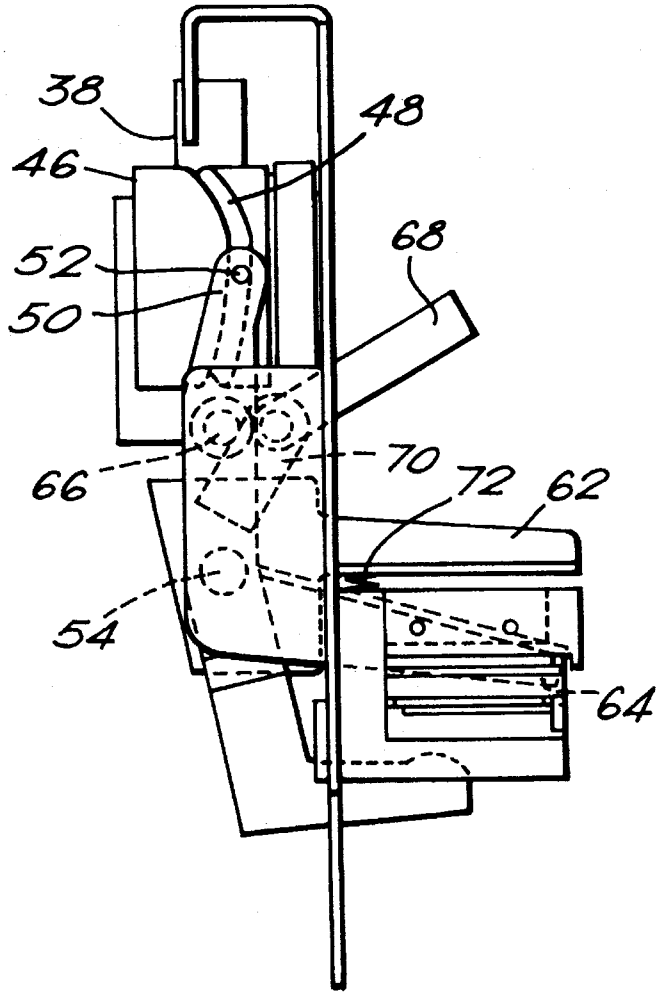

FIGS. 3 and 4 are side views and plan views respectively of a cutting mechanism of the printing device. A cutter motor 36 drives a worm gear 38. This drives a gear train comprising three gears 40,42,44, the last gear 44 then driving a cam 46. The cam 46 has in its surface a cam track extending circumferentially and asymmetrically. A tab cut lever arm 50 runs in the cam track 48 via a pin 52. The tab cut leer arm is pivotably mounted about a pivot point 54 and is arranged so that it can be brought into contact with a spring loaded blade holder designated generally by reference numeral 56 to bring a blade 58 into contact with an anvil 60. The blade holder 56 is biased by a spring 57. In an alternative arrangement, the anvil 60 could be biased instead of the blade holder 56. The blade 58 is not designed to cut entirely through the tape but is designed to cut only through the image receiving layer of the image receiving tape 4 and not through the releaseable backing layer. A cut is made through all of the layers of the image receiving tape to cut off a portion of tape once printed by two cooperating blades 62,64 operating as scissors. The blade 62 remains stationary while the blade 64 is pivoted about pivot point 54. A pin 66 secures the blade 64 to the tab cut lever arm 50 so that the blade 64 moves with the lever arm 50. In this way upward movement of the blade 64 occurs in response to movement of the tab cut lever arm 50 in the cam track 48. The pin 66 can be disengaged from the tab cut lever arm 50 by use of a disengagement lever 68. The disengagement lever causes a cam 70 to rotate, the surface of the am 70 being such that its rotation allows the pin 66 to move out of contact with the tab cut lever arm 50 under the action of a spring 72.

The cutting mechanism can operate in two ways. In the first mode, the pin 66 secures the blade 64 to the tab cut lever arm 50. As the cam 46 rotates, the tab cut lever arm 50 is caused to move in the track 48 into a cutting position where it brings the blade 58 into contact with the anvil 60. At the same time, the blade 64 is brought into contact with the blade 62 to perform a scissor cut. Thus, a portion of a printed tape is cut off while a tab cut 200 (see FIG. 6*a*) is made at a short distance from the main cut. In the second, "strip label" mode, the disengagement lever 68 has been rotated so that the pin 66 no longer secures the blade 64 to the tab cut lever arm 50. In these circumstances, the scissors do not operate as the cam 46 rotates but instead only a tab cut is performed at a series of locations. This provides the facility to have a continuous tape printed with a series of labels separated by individual tab cuts (as shown in FIG. 6*b*). The way in which this is achieved will be described in more detail hereinafter.

The basic circuitry for controlling the printing device is shown in FIG. 5. There is a microprocessor chip 100 having a read only memory (ROM) 102, a microprocessor 101 and random access memory capacity indicated diagrammatically by RAM 104. The microprocessor is connected to receive data input to it from a data input device such as a keyboard 106. The microprocessor chip 100 outputs data to drive a display 108 via a display driver chip 109 and also to drive the print head 16 and the stepper motor 18 for controlling the platen 8. The microprocessor chip also controls the cutting mechanism indicated diagrammatically in FIG. 5 by cutter 17 to cut the printed tape.

Figure 7:
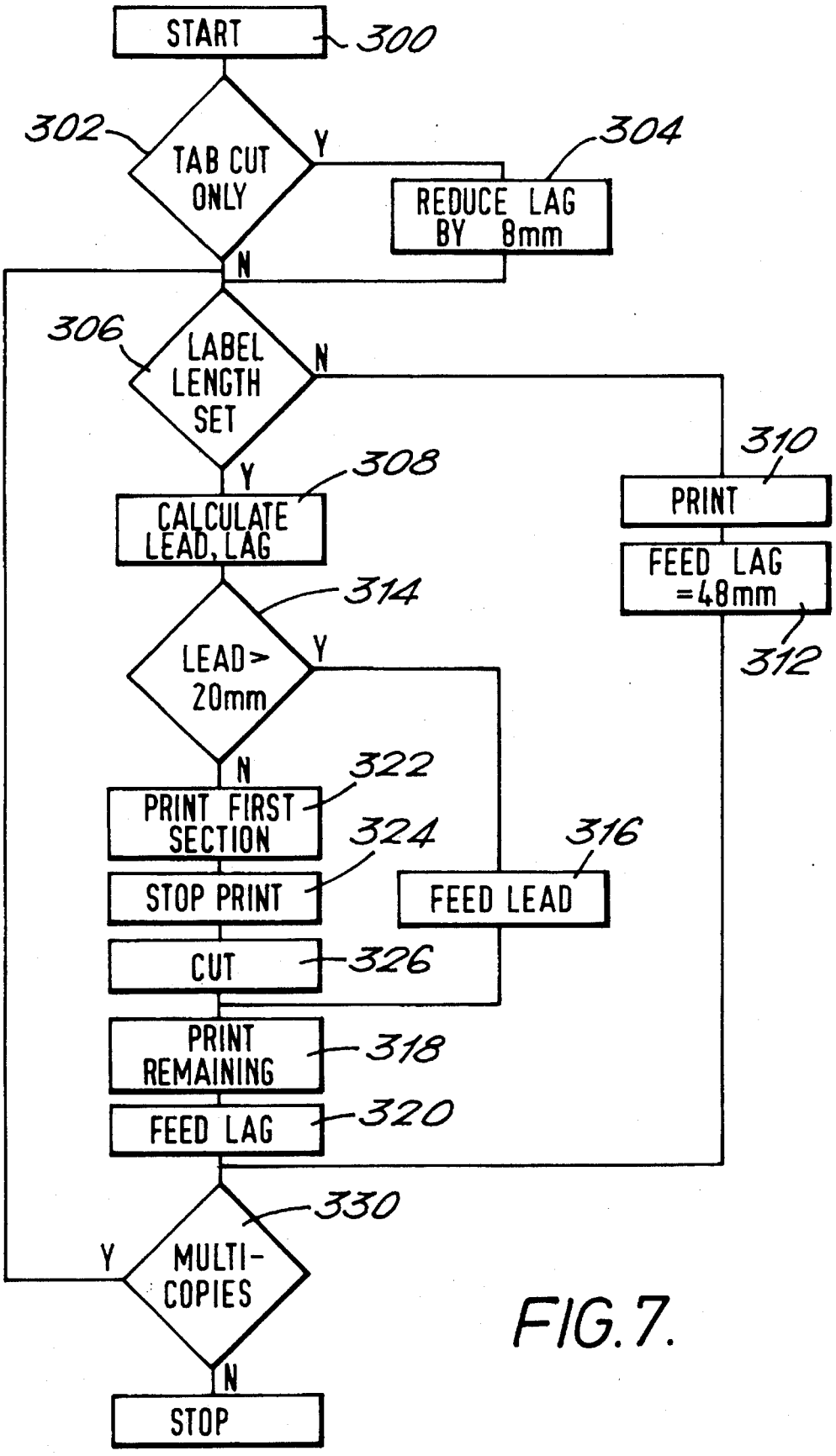
FIG. 7 is a flow chart for controlling the printing device in one mode.

Firstly, the use of the printer in its normal cutting mode will be described with reference to FIG. 7. Data to be printed is typed into the printing device using data input keys on the keyboard 106. The data input keys are designated generally by the block 109 but will in practice comprise a plurality of lettered and numbered keys. As the data is entered into the keyboard 106 it is supplied to the microprocessor 101 which drives the display 108 to display the data as it is entered. To do this, for each character which is entered, the microprocessor calls up a stored version of the character from a ROM 102. As the character is stored in compressed form this font data is stored temporarily in the RAM 104 and is manipulated by the microprocessor 101 to generate pixel data to form the character. This pixel data is transmitted in one form to the display 108 and in another form to the print head for printing. Character data is not Passed to the print head for printing until a print operation is executed. Firstly, the characters for the label are entered and edited using function keys on the keyboard 106 in conjunction with the display 108.

Once the final form of the label has been worked out, the microprocessor has worked out the pixel data for each column to be printed and has also calculated the overall length of the label and the position of the print within the label. This is represented by step 306 "Label Length Set" and step 308 "Calculate lead, lag".

That is, in this mode each label will have a short lead length and tail length of blank tape. These lead and tail lengths and the length of print are stored in the microprocessor. The lengths stored in the microprocessor can be used to control movement of the tape as described hereinafter by conversion of the stored lengths into pulses used to drive the stepper motor.

When a print operation is instigated using the print key 112, there is a length of tape (20 mm in the described embodiment) extending between the print head and the scissor cutting mechanism, and printing starts at the position on the tape at the print head 16. Where the label length has not been set, printing commences as shown in step 310. A column of pixel data is transferred to the print head which prints this column on the image receiving tape. The stepper motor then moves the image receiving tape forward by one column width and the next column data is transferred to the print head and printed. In this way, an entire label is printed. When the complete label has been printed, the stepper motor 18 moves the image receiving tape to a distance corresponding to twice the distance between the print head and the zone where the scissor cut is implemented plus the distance between the scissor cut and the tab cut (8 mm). This is indicated by step 312. This ensures that the tab cut defines the finished label with the printed position centralised, i.e. with 20 mm lead and 20 mm lag. The cutting operation is then executed to simultaneously cut off the printed portion of the tape constituting the label and to perform a tab cut 200 in the label. The resulting label is shown in FIG. 6*a*, with the print portion centralised and a lead and lag each of 20 mm.

When the label length has been set (step 306') and the lead and lag calculated so that the printed part is preferably, but not necessarily, centralised, the microprocessor determines at step 314 whether the lead exceeds 20 mm. If it does the stepper motor advances the tape at step 316 by a distance exceeding the distance (20 mm) between the print head and the scissor cut zone and then begins printing at step 318. After printing, the stepper motor advances the tape by a distance corresponding to the distance between the print head and the scissor cut zone by the difference between the lead length and 20 mm plus the extra distance where the lag exceeds 20 mm plus the distance between the scissor cut zone and the tab cut zone. The label is then cut off and a tab cut simultaneously implemented. If multiple copies (step 330') are required the loop begins again at step 306, otherwise the device stops.

If the lead does not exceed 20 mm the distance between 20 mm and the lead is stored and the controller proceeds to step 322 to print a first portion of the label. During printing the tape is fed towards the cutting zone stepwise as each column is printed. When the label has been fed through the stored distance under the control of a pulse string corresponding to that stored distance printing is temporarily inhibited at step 324 and the scissor cut is implemented at step 326 to cut off the leading part of the tape. It will be apparent that the leading edge of the label does not coincide with the beginning of print but will always be spaced from it by a blank lead length determined by the microprocessor. Printing then proceeds at step 318 as before.

For some applications it is desirable to be able to produce a continuous strip of labels, not entirely separated from one another but each being removable individually from a common backing layer. In order to implement this mode with the described printing device, the scissor cut is disabled by the disengagement lever 68. The movement of this lever can be automatically sensed by a sensor on the lever connected to the microprocessor to implement the strip label mode or, alternatively, the strip label mode can be selected by use of a key on the keyboard 106. An exemplary key is designated by reference numeral 110 in FIG. 5. The selection of this mode is detected at step 302 and causes the microprocessor to be aware that the distance between the print head and the cutting zone now differs from that which it would be if the scissor cut were to be implemented. Thus, the tail length (lag) is reduced by 8 mm.

The microprocessor then controls printing as described above. As with the normal mode, printing of the first label starts at the zone where the tape is held between the print head 16 and the platen 8. Printing is carried out until a complete label has been printed. The microprocessor has calculated a label start position which is a distance spaced from the print start position by an amount corresponding to the lead length of the label. When the label start position which is designated by reference numeral 202 in FIG. 6*b* reaches the tab cut blade 58 further feeding of the tape is inhibited and a cutting operation is automatically carried out to perform a tab cut at the lead of the label. Further feeding of the tape is then commenced. The microprocessor controls the feed of tape to accommodate the lead length of the label, its print length and tail length and the lead length of the subsequent label so as to commence printing at the beginning of the print start portion of the next label. If a situation arises that the printing mechanism is operable when a cut is to be made, the microprocessor not only inhibits further feeding but also inhibits printing while cutting is carried out.

That is, in contrast to the situation outlined in the normal mode where the scissor cut is performed to cut off a complete portion of the tape, the microprocessor has to recalculate the distance through which the image receiving tape is moved between cuts. At each cut position, a cut is made only through the upper layer 4*a* so that a strip of labels is produced as shown in FIG. 6*b*.

In this mode, the printing device will not print and cut off a normal label until the lever 68 is returned to its correct position. It may signal to the user by a symbol on the display 108 that the lever should be moved so that normal cutting mode can be resumed.

Figure 8:
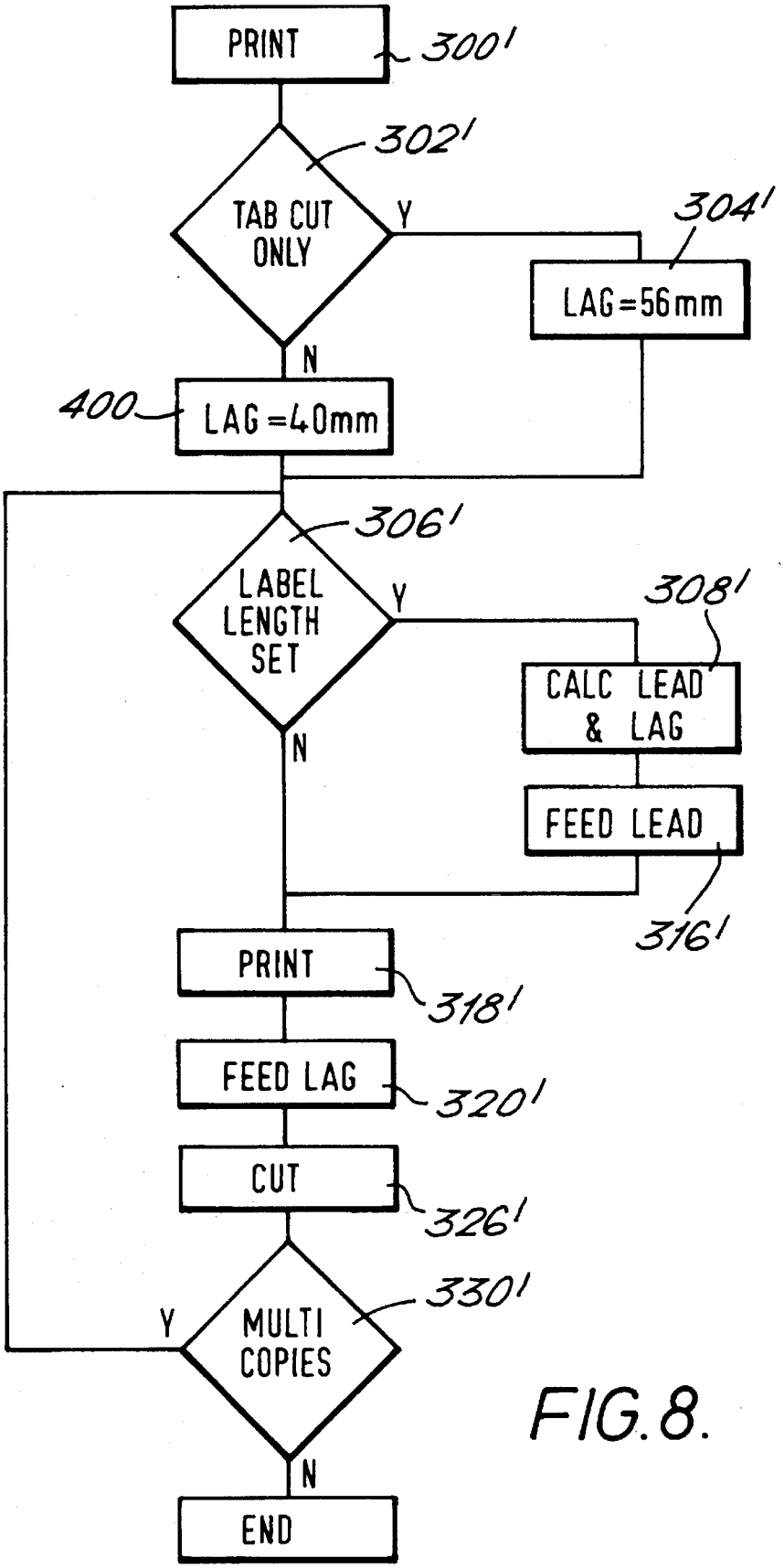
FIG. 8 is a flow chart for controlling the printing device in another mode.

FIG. 8 shows another mode of operation of the printing device which is simpler to implement and in which so-called "short" labels are not produced. In FIG. 8, like numerals, but primed, and used to denote equivalent steps to those given in FIG. 7 for ease of comparison. In the normal cutting mode, a print instruction 300' starts the printing process. As the multiple strip mode is not selected, the lag length of the label is set to 40 mm as indicated in step 400. Where a particular label length has not been set, printing commences as shown in step 318'. When the complete label has been printed, the stepper motor 18 moves the image receiving tape to a distance corresponding to the lag as indicated by step 320'. A cutting operation is then implemented as denoted at 326'.

In cases where the label length has been set, as indicated at step 306' the appropriate lead and lag for the label are calculated to centralise the printed part of the label or to provide it with predetermined lead length and lag length without necessarily centralising the print as denoted at step 308'. The appropriate lead length is then fed without printing as denoted at step 316' and the printing sequence is then instigated as described earlier.

In both cases, if multiple copies are required the loop begins again at step 306', otherwise the device stops.

In so-called multiple strip mode, ,which is denoted by step 302' (tab cut only), the lag length is set at 56 mm as denoted by step 304'. Otherwise, the process proceeds as before.

What is claimed is:

1. A printing device comprising:

means for printing a desired image onto an image receiving tape and for providing labels therefrom, said image receiving tape comprising an image receiving layer for receiving an image and a releaseable backing layer; and said printing means comprising data input keys for inputting data corresponding to an image to be printed;

first cutting means arranged at a first cutting zone to cut off a portion of the image receiving tape which has been printed by cutting completely through both layers which comprise said tape;

second cutting means arranged at a second cutting zone to cut through the image receiving layer of the image receiving tape while leaving the backing layer substantially intact, said second cutting zone being spaced from said first cutting zone; and means for disabling said first cutting means while permitting operation only of said second cutting means, wherein said printing device has a strip label mode of operation in which said disabling means disables said first cutting means and the printing device is operable to print said image from said data which is input via said data input keys onto a portion of the image receiving tape, to feed the image receiving tape to the second cutting zone, to cut through the image receiving layer with said second cutting means, leaving said backing layer intact, and to repeat said operations for subsequent portions of the image receiving tape whereby a continuous strip of labels is produced, said printing device having second mode of operation in which individual labels are produced, the printing device being operable in said second mode to print said image via said data input keys onto a portion of the image receiving tape and to feed the image receiving tape to the first and second cutting zones wherein the the first cutting means is operable to cut through the image receiving layer of the image receiving tape while leaving the backing layer substantially intact, whereby individual labels having a tab cut are provided in said second mode of operation.

2. A printing device according to claim 1, wherein the first and second cutting means are driven from a common drive mechanism and the means for disabling the first cutting means comprises means for disconnecting the first cutting means from the drive mechanism.

3. A printing device according to claim 2, wherein the second cutting means is driven through a control arm and a spring loaded pin secures the first cutting means to the control arm of the second cutting means, the printing device comprising a lever which actuates a cam such than on rotation of the lever and the cam the pin is caused to move under the action of the spring to disconnect the first cutting means from the control arm.

4. A printing device according to any one of claims 1 to 3, wherein the first cutting means comprises two blades which cooperate to form a scissor cut.

5. A printing device according to any one of claims 1 to 3, wherein the second cutting means comprises a resiliently mounted blade.

6. A printing device according to any one of claims 1 to 3, which comprises means for sensing movement of the disabling means to automatically instigate the strip label mode of operation.

7. A printing device according to any one of claims 1 to 3, which comprises a platen and a print head, the platen being rotatable to act as a feeding means to feed the image receiving tape to the cutting zone.

8. A printing device according to claim 7, wherein the feeding means is associated with a controller which is operable to receive data input by a user representative of characters to be printed and to control the feeding means in response thereto.

9. A printing device according to claim 8, wherein the controller is operable to calculate a length of label to be printed including the length of a lead part of blank tape before a print start position and a length of a lag part of blank tape after a print end position.

10. A printing device according to claim 7, wherein the controller is operable to control the feeding means via a stepper motor by converting the calculated lead, lag and print lengths into appropriate pulse strings for supplying to the stepper motor, each pulse string having an appropriate number of pulses equivalent to the calculated feed length.

11. A tape cutting apparatus for a printing device comprising:

a tape having an image receiving layer on which an image has been printed and a releasable backing layer;

first cutting means arranged to cut off a portion of said tape by cutting completely through said tape and comprising two blades cooperable to form a scissor cut;

second cutting means comprising a blade holder in which said blade is mounted, a support for the blade holder, and biasing mean for resiliently mounting said blade holder with respect to the support said second cutting means being arranged to cut completely only through one of said layers of tape and not through the other of said layers; and drive means controllable to actuate the first and second cutting means so that said first cutting means cuts off said portion of said tape thus leaving a cut off edge while said second cutting means cuts only through said one layer of said tape at a position spaced apart from the cut off edge.

12. A tape cutting apparatus according to claim 1, wherein one of the blades of the first cutting means is fixed while the other of the blades is arranged to move towards the fixed blade when actuated by the drive means.

13. A tape cutting apparatus according to claim 12, wherein the moving one of the blades is secured to a control arm which actuates the resiliently mounted blade of the second cutting means.

14. A tape cutting apparatus according to any one of claims 1 to 3, wherein the resiliently mounted blade acts against an anvil.

15. A tape cutting apparatus according to claim 11 wherein the drive means comprises an electric motor and a gear train, and said biasing means comprises a spring.

16. A tape cutting apparatus according to claim 15, wherein the gear train comprises a worm gear which drives through at least an intermediate gear a cam having a cam track in which rides a control arm.

17. A tape cutting apparatus according to claim 1 further comprising disconnecting means operable to disconnect the first cutting means from the drive means while the second cutting means remains driven thereby.

18. A printing device comprising:

an image receiving tape comprising an image receiving layer for receiving an image and a releaseable backing layer; and means for printing a desired image onto the image receiving tape, said printing device comprising:

first cutting means arranged at a first cutting zone to cut off a portion of the image receiving tape which has been printed;

second cutting means arranged at a second cutting zone to cut through the image receiving layer of the image receiving tape while leaving the backing layer substantially intact, said second cutting zone being spaced from said first cutting zone;

a common drive mechanism for driving said first and second cutting means, said common drive mechanism comprising a control arm through which said second cutting means is driven and a spring loaded pin which secures the first cutting means to the control arm; and means for disabling said first cutting means while permitting operation only of said second cutting means, said means for disabling the first cutting means comprising means for disconnecting the first cutting means from the common drive mechanism, said disconnecting means having a lever which actuates a cam such that on rotation of the lever and the cam said spring loaded pin is caused to move under the action of the spring to disconnect the first cutting means from said control arm, wherein said printing device has a strip label mode of operation in which said disabling means disables said first cutting means and the printing device is operable to print an image onto a portion of the image receiving tape, to feed the image receiving tape to the second cutting zone, to cut through the image receiving layer and to repeat said operations for subsequent portions of the image receiving tape whereby a strip of labels is produced.

19. A printing device according to claim 18, wherein the first means comprises two blades which cooperate to form a scissor cut.

20. A printing device according to claim 18, wherein the second cutting means comprises a resiliently mounted blade.

21. A printing device according to claim 18, which comprises means for sensing movement of the disabling means to automatically instigate the strip label mode of operation.

22. A printing device according to claim 18, which comprises a platen and a print head, the platen being rotatable to act as a feeding means to feed the image receiving tape to the cutting zone.

23. A printing device according to claim 22, wherein the feeding means is associated with a controller which is operable to receive data input by a user representative of characters to be printed and to control the feeding means in response thereto.

24. A printing device according to claim 23, wherein the controller is operable to calculate a length of label to be printed including the length of a lead part of blank tape before a print start position and a length of a lag part of blank tape after a print end position.

25. A printing device according to claim 22, wherein the controller is operable to control the feeding means via a stepper motor by converting the calculated lead, lag and print lengths into appropriate pulse strings for supplying to the stepper motor, each pulse string having an appropriate number of pulses equivalent to the calculated feed length.

26. A printing device comprising means for printing a desired image onto an image receiving tape:

said printing device comprising an image receiving layer for receiving an image and a releasable backing layer; and said printing device comprising:

first cutting means arranged at a first cutting zone to cut off a portion of the image receiving tape which has been printed;

second cutting means arranged at a second cutting zone to cut through the image receiving layer of the image receiving tape while leaving the backing layer substantially intact, said second cutting zone being spaced from said first cutting zone;

means for disabling said first cutting means while permitting operation only of said second cutting means, said printing device having a strip label mode of operation in which said disabling means disables said first cutting means and the printing device is operable to print an image onto a portion of the image receiving tape, to feed the image receiving tape to the second cutting zone, to cut through the image receiving layer and to repeat said operations for subsequent portions of the image receiving tape whereby a strip of labels is produced; and means for sensing movement of the disabling means to automatically instigate the strip label mode.

27. A printing device according to claim 26, wherein the first and second cutting means are driven from a common drive mechanism and the means for disabling the first cutting means comprises means for disconnecting the first cutting means from the drive mechanism.

28. A printing device according to claim 26, wherein the first cutting means comprises two blades which cooperate to form a scissor cut.

29. A printing device according to claim 26, wherein the second cutting means comprises a resiliently mounted blade.

30. A printing device according to claim 26, which comprises a platen and a print head, the platen being rotatable to act as a feeding means to feed the image receiving tape to the cutting zone.

31. A printing device according to claim 30, wherein the feeding means is associated with a controller which is operable to receive data input by a user representative of characters to be printed and to control the feeding means in response thereto.

32. A printing device according to claim 31, wherein the controller is operable to calculate a length of label to be printed including the length of a lead part of blank tape before a print start position and a length of a lag part of blank tape after a print end position.

33. A printing device according to claim 30, wherein the controller is operable to control the feeding means via a stepper motor by converting the calculated lead, lag and print lengths into appropriate pulse strings for supplying to the stepper motor, each pulse string having an appropriate number of pulses equivalent to the calculated feed length.

* * * * *